United States Patent [19]

Fletcher et al.

[11] 4,077,231

[45] Mar. 7, 1978

[54] MULTISTATION REFRIGERATION SYSTEM

[76] Inventors: James C. Fletcher, Administrator of the National Aeronautics and Space Administration, with respect to an invention of Ervin R. Wiebe, Sunland, Calif.

[21] Appl. No.: 712,981

[22] Filed: Aug. 9, 1976

[51] Int. Cl.[2] ..... F25B 19/00

[52] U.S. Cl. ..... 62/514 R; 250/332; 313/22

[58] Field of Search ..... 62/6, 514 R; 313/11, 313/22, 35; 250/332

[56] References Cited

U.S. PATENT DOCUMENTS

| | | | |
|---|---|---|---|
| 3,878,691 | 4/1975 | Asztalos | 62/514 R |
| 3,882,687 | 5/1975 | Asztalos et al. | 62/514 R |
| 3,894,403 | 7/1975 | Longsworth | 62/514 R |

*Primary Examiner*—Ronald C. Capossela
*Attorney, Agent, or Firm*—Monte F. Mott; John R. Manning; Wilfred Grifka

[57] ABSTRACT

A closed cycle refrigeration (CCR) system is disclosed for providing cooling at different temperatures to different parts of a maser. The CCR includes a first station for cooling the maser's parts, except the amplifier portion, to 4.5° K. The CCR further includes means with a 3.0° K station for cooling the maser's amplifier to 3.0° K and, thereby, increases the maser's gain and/or bandwidth by a significant factor. The means which provide the 3.0° K cooling include a pressure regulator, heat exchangers, an expansion valve, and a vacuum pump, which coact to cause helium, provided from a compressor, to liquefy and thereafter expand so as to vaporize. The heat of vaporization for the helium is provided by the maser amplifier, which is thereby cooled to 3.0° K.

17 Claims, 2 Drawing Figures

MULTISTATION REFRIGERATION SYSTEM

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 USC 2457).

BACKGROUND OF THE INVENTION

1. Field of the Invention

The present invention relates to a refrigeration system and, more particularly, to a multistation cryogenic refrigeration system.

2. Description of the Prior Art

The prior art and the present invention will be described for use in connection with masers. However, it will become apparent from the following description that the invention is not intended to be limited thereto. The need to provide refrigeration at cryogenic temperatures for the proper operation of masers, such as the microwave masers at S, X and $K_u$ band frequencies, is well known. 4.5° K closed-cycle refrigeration systems (CCRs) are currently used in the Deep Space Network for such masers. Such refrigeration systems have been described in the prior art. Attention is directed to but two prior art references.

(a) "A Simplified Approach to Heat Exchanger Construction for Cryogenic Refrigerators," by W. H. Higa and E. Wiebe, Cryogenic Technology, Vol. 3, pp 47051, March/April 1967.

(b) "Low Noise Receivers: Microwave Maser Development" by R. Clauss, E. Weibe and R. Quinn, in *The Deep Space Network Progress Report,* Technical Report 32-1526, Vol. XI, pp. 71–80, Jet Propulsion Laboratory, Pasadena, Calif., Oct. 15, 1972.

As described in reference (b), an X-band maser achieved 45dB net gain and had a theoretical noise temperature of 3.5° K (defined at the maser input connection at the final stage of refrigeration), when operated at 4.5° K. A CCR, providing refrigeration at about 4.5° K is described in reference (a) as well as in U.S. Pat. No. 3,421,331 issued with respect to an invention of Walter H. Higa on Jan. 14, 1969.

To date in known CCRs, used with masers, the coldest station is at about 4.5° K which is the temperature at which most of the maser's parts, such as the large superconductive magnet, has to be maintained for satisfactory performance. It is appreciated that if the temperature of the maser's amplifier, such as the ruby in a ruby maser, were reduced from 4.5° K to 3.0° K, the maser noise would decrease from 3.5° K to 2.0° K, resulting in a gain increase from 45dB to 72dB. Such gain increase can be traded for additional bandwidth.

It is recognized that the basic known CCR may be operated to provide a coldest station of 3.0° K, rather than at 4.5° K. However, to provide a coldest station at 3.0° K to cool all the maser's parts, including those of high heat capacity, a very large vacuum pump would be required, which would greatly increase the cost and size of the CCR. Since except for the maser amplifier all other parts require a lowest temperature of only 4.5° K, rather than at 3.0° K, in order to reduce the CCR's size, complexity and cost, even though higher gain could have been attained if the CCR were to provide refrigeration at 3.0° K. A need therefore exists for a CCR in which 3.0° K refrigeration is provided without significantly increasing the size, complexity and cost of the CCR.

OBJECTS AND SUMMARY OF THE INVENTION

It is a primary object of the present invention to provide a new improved cryogenic refrigeration system.

Another object of the present invention is to provide a new cryogenic refrigeration system for cooling different parts of a system to different temperatures.

A further object of the invention is to provide a cryogenic refrigeration system in which a cooling station at about 4.5° K is provided as well as a station at a lower temperature without significant increase in size and cost of the system as compared with the size and cost of a system with a coldest station at about 4.5° K.

These and other objects of the invention are achieved by providing a refrigeration system, e.g., a CCR which includes those parts needed to provide a station at about 4.5° K, to which the maser's parts, except the amplifier, are thermally connected. In addition, the CCR of the invention includes means for providing a station at about 3.0° K to which only the amplifier of the maser is thermally coupled. The thermal capacity of the 3.0° K station is chosen to be of thermal capacity sufficient to maintain the maser amplifier at about 3.0° K. Thus, the parts necessary to maintain the maser's amplifier at 3.0° K are relatively small and inexpensive and, therefore, do not add appreciably to the overall size and cost of the CCR which includes the 4.5° K station designed to cool the rest of the maser.

The novel features of the invention are set forth with particularity in the appended claims. The invention will best be understood from the following description when read in conjunction with the accompanying drawings.

DESCRIPTION OF THE PREFERRED EMBODIMENTS

Figure 1:
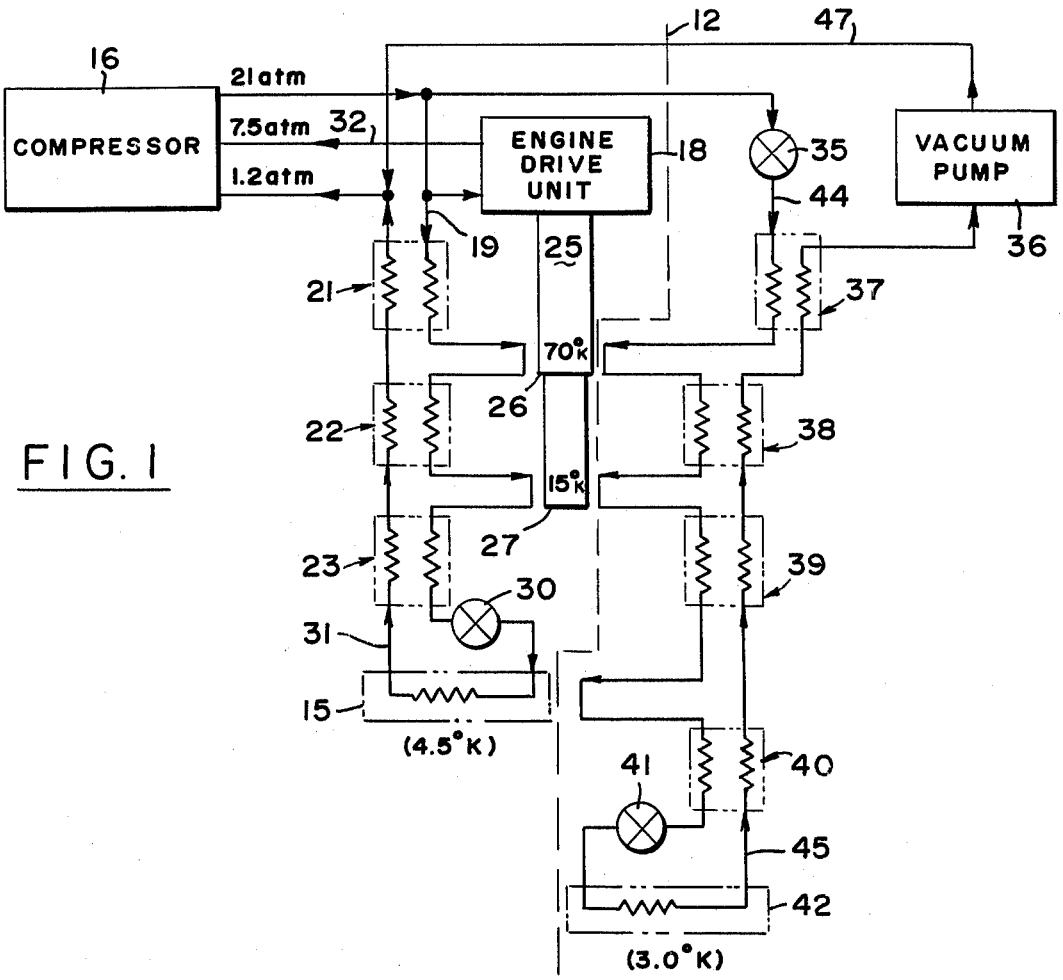
FIG. 1 is a block and schematic diagram of a closed cycle refrigeration system with 4.5° K and 3.0° K cooling stations.

Attention is now directed to FIG. 1 which is a block diagram of one embodiment of a CCR system in accordance with the present invention in which helium is the refrigerant and wherein two cooling stations at about 4.5° K and at about 3.0° K are provided. All the parts to the left of dashed line 12 represents a CCR with a coldest station 15 at about 4.5° K, such as the one described in the above cited reference (a). Basically, it includes a compressor 16 which supplies helium at high pressure, e.g., 21 atm. to an engine drive unit 18 and to an inlet line 19 of three successively connected counterflow heat exchangers 21, 22 and 23.

The drive unit 18 drives a displacer-regenerator assembly 25 which defines cooling stations 26 and 27 at 70° K and 15° K, respectively. A Joule-Thompson (J-T) valve 30 provides J-T expansion of the helium, exiting exchanger 23 to provide 4.5° K cooling at station 15. The helium from station 15 is returned to the low pressure, e.g., 1–2 atm., inlet of compressor 16 through counterflow line 31 of the heat exchangers 21–23. Also, the helium from the drive unit 18 is returned to the compressor 16, via line 32, to the compressor's intermediate inlet. The manner of operation of the parts of the CCR, described thus far, to provide 4.5° K at station 15 is well known and therefore will not be described in detail.

In the prior art CCR the coldest station is station 15 at 4.5° K to which all the maser parts requiring cooling are attached. As previously pointed out the disadvantage of such a CCR is that it does not provide cooling at about 3.0° K so as to cool the maser's amplifier and thereby provide higher gain. Such cooling however, is provided in the CCR of the present invention by the incorporation of the circuitry shown to the right of line 12.

In accordance with the present invention the CCR includes a pressure regulator 35, a vacuum pump 36, four heat exchangers 37–40, and an expansion valve 41, to provide cooling at about 3.0° K at a station 42 to which the maser amplifier is assumed to be attached. Basically, the helium at high pressure (21 atm.) from compressor 16 is supplied to pressure regulator 35, which regulates the pressure in the inlet line 44 of successively connected heat exchangers 37–40. The helium in line 44, exiting each of exchangers 37–39 is cooled to 70° K, 15° K and 4.5° K at stations 26, 27 and 15, respectively. Thus, the helium entering exchanger 40 is at 4.5° K. The helium from exchanger 40 is supplied to expansion valve 41 and therefrom it flows through station 42 and the counterflow line 45 of the four heat exchangers 37–40 to the vacuum pump 36. The helium from the latter flows to the compressor low pressure inlet via line 47. In operation the vacuum pump provides a partial vacuum in counterflow line 45 while its outlet line 47 is regulated to a pressure of about 1.2 atm.

The pressure regulator 35 regulates the pressure of the helium in inlet line 44 so that the helium after it is cooled at station 15 to 4.5° K is in the liquid state. Since the critical point of helium is at 5.2° K and 2.2 atm. this can easily be accomplished by regulating the pressure in line 44 to be about 3 atm. The helium in line 44 entering and exiting exchanger 40 is in its liquid state. As it passes through valve 41 it expands due to the partial vacuum provided by vacuum pump 36 in line 45 and therefore it evaporates, i.e., boils. The heat of vaporization is provided by the maser amplifier or any other parts which are assumed to be thermally connected to station 42. Thus, while liquid helium enters the expansion valve 41, helium vapor is formed on the downstream end of the valve, i.e, in station 42 and line 45. The helium vapor, entering exchanger 40 is at a lower temperature than the liquid helium entering the exchanger 40 which is at 4.5° K. Therefore, the liquid helium as it passes in exchanger 40 in line 44 is cooled and is at a temperature lower than 4.5° K when it reaches valve 41.

The partial vacuum which vacuum pump 36 provides and the flow rate of the helium in the lines 44 are chosen to provide the required net cooling (refrigeration) capacity of station 42 at about 3.0° K. In one embodiment the required net refrigeration capacity is about 200mw to maintain the maser amplifier at about 3.0° K. The portion of the CCR to the left of line 12 provides a net refrigeration capacity of about 500mw at 4.5° K at station 15. In one embodiment actually reduced to practice the vacuum pump 36 consists of a pump manufactured by Sargent-Welch known as Model 8815 Director. It is a pump with a free air displacement of 150 liters per minute. The 3.0° K at a capacity of 200mw is provided at a helium flow rate of approximately 8 standard liters per minute.

It should be appreciated that the parts of the CCR to the right of line 12, which provide the 3.0° K at station 42, operate in a manner similar to a conventional home refrigerator. That is, a refrigerant which in the CCR is helium in liquid form, is expanded by expansion valve 41 to a lower pressure, causing the refrigerant to vaporize or boil. As it vaporizes it absorbs heat of vaporization from the parts or items to be cooled. In the present invention such parts are included in an otherwise conventional CCR to provide 3.0° K net refrigeration capacity only for the maser amplifier. The rest of the CCR provides 4.5° K cooling for the rest of the maser parts. Since the 3.0° K portion of the CCR has to cool only the maser amplifier, its net refrigeration capacity is small and therefore the parts needed to provide the 3.0° K cooling are relatively small.

It should be pointed out that, if desired, at least the heat exchangers 37–39 may be eliminated. However, by including them the counterflowing colder helium in line 45 is used to cool the incoming helium in line 44. Therefore, less heat is delivered by the helium to the 4.5° K, 15° K, and 70° K stations 15, 27 and 26, respectively. Alternately stated, by incorporating the heat exchangers 37–39, the stations 15, 27 and 26 are subjected to a minimum of added cooling load by the helium flowing in line 44 which is used to provide the 3.0° K cooling at station 42.

Figure 2:
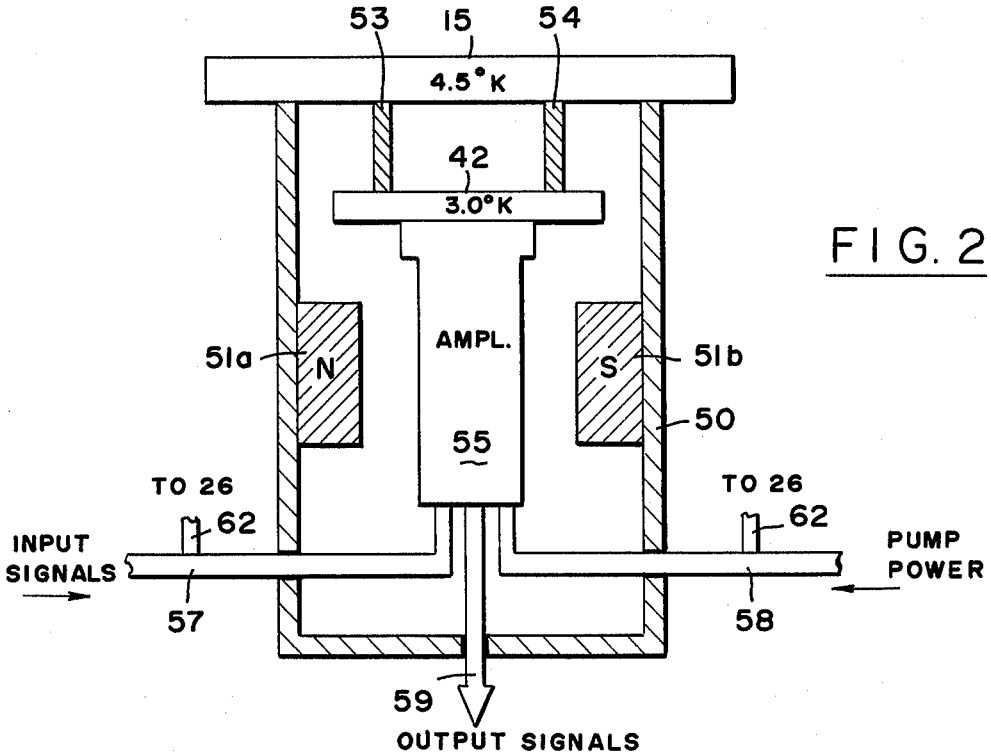
FIG. 2 is a simplified diagram of various parts of a maser thermally coupled to these stations.

Attention is now directed to FIG. 2 which is a simplified cross-sectional diagram of the manner attaching the various maser parts to the cooling stations 15 and 42 of the CCR. In FIG. 2 numeral 50 designates the maser housing, which in practice is evacuated. It is physically and thermally attached to the 4.5° K station 15. The maser magnet, represented by pole pieces 51*a* and 51*b*, is attached to the housings and therefore is also cooled to 4.5° K. The 3.0° K station 42 is shown supported by station 15 through thermally insulating support members 53 and 54. The maser amplifier 55, such as a ruby, is thermally connected to station 42 and therefore is maintained at 3.0° K.

The input signals to the amplifier 55 are applied through a waveguide 57, which is in thermal contact with housing 50. Similarly, the pumping power is applied to the maser amplifier through a waveguide 58 which is in thermal contact with housing 50. The output signals from amplifier 55 are applied to a waveguide 59 (or coax) which extends from housing 50 and is also in thermal contact therewith.

The portions of waveguides 57–59 in housing 50 are made quite short. Since each of these waveguide portions is connected at one end to the amplifier 55 at 3.0° K and is also in thermal contact with housings 50 which is at 4.5° K, a thermal gradient between 3.0° K and 4.5° K is present on each of these waveguide portions. By making these portions of thin walled stainless steel, which is a good thermal insulator at low temperatures, the thermal load which they present to the 3.0° K station 42 is held to a minimum. In practice, at some points along the portions of the waveguides outside the maser housing 50 the waveguides are thermally connected to one of the higher temperature stations such as the 70° K station 26 by means of high thermally conductive linkage members 62.

It should be appreciated that the novel CCR of the present invention in which two cooling stations are provided to cool different parts of a maser to different temperatures is not intended to be limited to cooling maser parts. It can be used to cool different parts of any system to different temperatures, which are assumed to be below the critical temperature of helium, i.e., below 5.2° K. For example, the CCR may be used to cool different parts of an infrared (IR) detector to two temperatures below 5.2° K.

Although particular embodiments of the invention have been described and illustrated herein, it is recognized that modifications and variations may readily occur to those skilled in the art and consequently, it is intended that the claims be intrepted to cover such modifications and equivalents.

What is claimed is:

1. In a refrigeration system of the type including a source of helium gas and including a first cooling station for cooling parts thermally attachable thereto to a first temperature less than the critical temperature of helium, an arrangement comprising:

means for providing a preselected capacity of net cooling at a second temperature, lower than said first temperature, said means including first means for receiving helium gas from said source and for controlling the pressure and temperature of the helium gas so as to liquefy the helium, and second means for causing said liquefied helium to expand, said means including a second station through which said expanded helium passes, said second station being adapted to have preselected means thermally coupled thereto whereby said preselected means are cooled to said second temperature by providing heat of vaporization for the expanded helium to vaporize.

2. The system as described in claim 1 wherein said first temperature is on the order of 4.5° K and said second temperature is on the order of 3.0° K.

3. The system as described in claim 1 wherein said preselected capacity of net cooling is on the order of the net cooling required to maintain a maser amplifier at said second temperature.

4. The system as described in claim 3 wherein said second temperature is on the order of 3.0° K.

5. The system as described in claim 4 wherein said preselected capacity of net cooling is on the order of 200mw.

6. The system as described in claim 1 wherein said first means include first flow means through which the received helium passes, which are in thermal contact with said first station so as to cool the received helium to said first temperature and means for regulating the pressure of the helium in said first flow means so as to liquefy the helium in said first flow means when the helium is cooled to said first temperature, and said second means include an expansion valve to which the liquefied helium in said first flow means is supplied, vacuum means, and second flow means coupled to the outlet end of said expansion valve and extending through said second station to said vacuum means, the latter providing a preselected pressure in said second flow means, whereby liquefied helium, exiting said expansion valve, expands due to the preselected pressure provided by said vacuum means and vaporizes by heat of varporization provided thereto by preselected means adapted to attach to said second station.

7. The system as described in claim 6 wherein said first flow means between said first station and said expansion valve and a portion of said second flow means between said second station and said vacuum means form a counterflow heat exchanger, whereby the helium in said second flow means at said second temperature cools the helium in said first flow means which flows to said expansion valve to a temperature below said first temperature.

8. The system as described in claim 6 wherein said second temperature is on the order of 3.0° K.

9. The system as described in claim 8 wherein the net cooling capacity of said second station is on the order of 200mw.

10. The system as described in claim 9 wherein said first and second stations are on the order of 4.5° K and 3.0° K, respectively.

11. A refrigeration system for cooling first selected parts of an apparatus to a first temperature and second selected parts of said apparatus to a second temperature below said first temperature where both said first and second temperatures are below the critical temperatures of helium, the system comprising:

a source of helium gas at a selected first pressure;

first means coupled to said source of helium for providing at a first station to which said first selected parts are attachable, a first selected refrigeration capacity at said first temperature; and second means coupled to said source of helium for providing at a second station, to which said second selected parts are attachable, a second selected refrigeration capacity at a second temperature less than said first temperature, which is less than the critical temperature of helium.

12. The system as described in claim 11 wherein said second temperature is on the order of 3.0° K and said apparatus is a maser and the second selected parts thereof is the maser amplifier.

13. The system as described in claim 11 wherein said second means include first flow means through which helium flows, with a portion of said first flow means being in thermal contact with said first station so as to cool the helium in said flow means to said first temperature.

14. The system as described in claim 11 wherein said second means include pressure regulating means for regulating the pressure of the helium gas received from said source and flowing in first flow means to be of a second pressure, so that when said helium in said first flow means cools to said first temperature it liquefies, said second means further including expansion valves coupled to receive said liquefied helium at an inlet end thereof and vacuum pump means coupled to the outlet end of said expansion valve through second flow means which pass through said second station, to provide a partial vacuum in said second flow means, whereby as the liquefied helium passes through said expansion valve its pressure drops and it vaporizes by absorbing heat of vaporization from said second parts attachable to said second station.

15. The system as described in claim 14 wherein said first flow means through which helium gas flows from said source to said expansion valve has a portion in thermal contact with said first station so that the helium in said first flow means is cooled at said first station to said first temperature.

16. The system described in claim 15 wherein said second temperature is on the order of 3.0° K and said apparatus is a maser and the second selected parts thereof is the maser amplifier.

17. The system as described in claim 16 wherein said first temperature is on the order of 4.5° K.

* * * * *